US006316769B2

(12) United States Patent
Takada et al.

(10) Patent No.: US 6,316,769 B2
(45) **Date of Patent: *Nov. 13, 2001**

(54) MASS SPECTROMETER

(75) Inventors: Yasuaki Takada, Kokubunji; Minoru Sakairi, Tokorozawa; Takayuki Nabeshima; Yukiko Hirabayashi, both of Kokubunji; Hideaki Koizumi, Tokyo, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/739,217

(22) Filed: Dec. 19, 2000

Related U.S. Application Data

(63) Continuation of application No. 09/447,578, filed on Nov. 23, 1999, now Pat. No. 6,180,941, which is a continuation of application No. 09/114,945, filed on Jul. 14, 1998, now Pat. No. 6,011,260, which is a continuation of application No. 08/831,486, filed on Mar. 31, 1997, now Pat. No. 5,825,027.

(30) Foreign Application Priority Data

Apr. 3, 1996 (JP) ..... 8-081186

(51) Int. Cl.[7] ..... H01J 49/42; H01J 49/04
(52) U.S. Cl. ..... 250/292; 250/288
(58) Field of Search ..... 250/292, 288

(56) References Cited

U.S. PATENT DOCUMENTS 5,373,156 12/1994 Franzen ..... 250/288
5,650,617 7/1997 Mordehai ..... 250/292
5,825,027 10/1998 Takada et al. ..... 250/292
6,011,260 1/2000 Takada et al. ..... 250/292
6,180,941 * 1/2001 Takada et al. ..... 250/292

OTHER PUBLICATIONS

Analytical Chemistry, 1990, vol. 62, No. 13, Jul. 1, 1990, "Electrospray Ionization Combined with Ion Trap Mass Spectrometry", G. Van Berkel et al, pp. 1284–1295.

* cited by examiner

*Primary Examiner*—Jack Berman
(74) *Attorney, Agent, or Firm*—Mattingly, Stanger & Malur, P.C.

(57) ABSTRACT

A mass spectrometer comprising an ionization means for ionizing sample compounds to be analyzed mass spectroscopically in an atmospheric pressure, a sample solution supply means for supplying a solution containing the sample compounds to the ionization means, means for feeding the ions formed by the ionization means through an aperture disposed in an electrode into a vacuum region and a ion trap type mass spectroscopic means for mass spectroscopically analyzing ions entered through the aperture into the vacuum region, in which an ion decelerating electric field forming means is disposed between the electrode disposed with the aperture and an electrode disposed with an ion entrance opening for entering the ions into the ion trap type mass spectroscopic means for forming an electric field for decelerating the ions, and the ions injected to the ion trap mass spectroscopic means is lowered. This facilitates accumulation ions in the ion trap mass spectralyzing means even if a high drift voltage is used thereby enabling high sensitivity analysis for polar compounds such as peptides.

5 Claims, 4 Drawing Sheets

MASS SPECTROMETER

This a continuation application of U.S. application Ser. No. 09/447,578, filed Nov. 23, 1999, now U.S. Pat. No. 6,180,941, which is a continuation application of U.S. application Ser. No. 09/114,945, filed Jul. 14, 1998, now U.S. Pat. No. 6,011,260, which is a continuation of U.S. application Ser. No. 08/831,486, filed Mar. 31, 1997, now U.S. Pat. No. 5,825,027.

BACKGROUND OF THE INVENTION

The present invention concerns a mass spectrometer for analyzing compounds in a solution and a combined device comprising a separation means in a liquid phase such as a liquid chromatograph and a mass spectrometer.

At present, importance is posed on a highly sensitive detection method of chemicals contained in solutions in the analytical science field. For example, with an increasing interest on ecological problems, regulations on chemicals contained in city water have become stringent year by year. Therefore, kinds of substances as objects for regulation and monitoring have been increased and the standard value for each of the substances has tended to be lowered. Since a mass spectrometer (hereinafter simply referred to as MS) has high sensitivity and excellent ability of identifying substances, it is effective for the analysis of chemicals in solutions. In particular, for the analysis of mixtures, it has been expected that a combined device comprising a separation means in a liquid phase such as a liquid chromatograph (hereinafter simply referred to as LC) or a capillary electrophoresis (hereinafter simply referred to as CE), and MS.

FIG. 5 shows a schematic configuration of a conventional ion trap mass spectrometer (refer to Analytical Chemistry, 62, 1284 (1990)). In the constitution of the prior art device, the polarity of a voltage applied to each of electrodes is selected depending on the polarity of ions to be analyzed. For the sake of simplicity, explanation will be made to a case of analyzing positive ions. A sample solution is introduced by way of a liquid feed pump 1 and a pipeline 2 to a metal tube 3. When a positive voltage at several kilovolts relative to an electrode 4 is applied to the metal tube 3 by a power supply 50, the sample solution is subjected to electrospray from the end of the metal tube 3. The liquid droplets formed by spraying contain a great amount of positive ions concerned with substances as an object for analysis. Since the liquid droplets are dried in the course of flying in atmospheric air, gaseous ions are formed. The thus formed gaseous ions enter through a first aperture 5, a differential pumping region 7 evacuated by a vacuum system 6*a* and a second aperture 8 into a vacuum region 20 evacuated by a vacuum system 6*b*. A voltage referred to as a drift voltage is applied between an electrode 4 disposed with the first aperture 5 and an electrode 9 disposed with the second aperture 8. The application of the drift voltage provides an effect of accelerating the ions and colliding them against residual gas molecules thereby eliminating solvent molecules attached to the ions and an effect of improving the ratio of the ions passing through the aperture 8 (transmission efficiency). The electrode 9 disposed with the second aperture 8 is grounded to the earth. For focusing the ions, electrostatic lenses 10*a* and 10*b* are disposed to the differential pumping region 7 and the vacuum region 20 respectively. The ion trap mass spectrometer comprises two endcaps 12*a* and 12*b* and a ring electrode 13. A high frequency voltage is applied to the ring electrode 13, to form an ion confining potential within an inner space 21 of the mass spectrometer 11. The inner space 21 of the mass spectrometer is at a pressure of about $10^{-3}$ Torr by the introduction of a helium gas referred to as a collision gas. Ions injected from an ion entrance opening 14 disposed to the endcap 12*a* collide against the helium gas molecules to lose their energy and confined by the confining potential in the mass spectrometer. After accumulating the ions in this way for a predetermined period of time in the space 21, the amplitude of the high frequency voltage applied to the ring electrode 13 is changed thereby making the trajectory of the ions unstable in the space 21 and the accumulated ions are ejected from the ion exit opening 15. Since the condition for making the ion trajectory unstable is different depending on the value obtained by dividing the mass (m) of the ion with the static charge (z) (m/z value), information on the m/z value of the ion can be obtained based on the amplitude value of the high frequency voltage applied on the ring electrode 13. Ions ejected from the exit opening 15 are detected by a detector 16, the detected signals are sent to a data processing device (not illustrated) and subjected to data processing. In FIG. 5, are shown electrodes 101 and 102 constituting the electrostatic lenses 10*a*, and electrodes 103, 104 and 105 constituting the electrostatic lens 10*b*.

The conventional ion trap mass spectrometer described above involves a problem that the ion detection sensitivity lowers if the drift voltage is increased. Since ions of polar compounds such as peptides have a number of solvent molecules such as water attached thereto, a high drift voltage is necessary for effectively removing such attached solvent molecules. Accordingly, it has been impossible to analyze polar compounds such as peptides at high sensitivity by the conventional ion trap mass spectrometer.

The reason is considered as below. In the ion trap mass spectrometer, the energy of ions injected to the mass spectrometer is important due to the necessity of accumulating the ions in the mass spectrometer. The injected ions lose their energy upon collision with the collision as in the mass spectrometer and are accumulated in the mass spectrometer. If the injected energy of the ions is excessively high, their energy can not be taken away completely by the collision against the collision gas but the ions pass through the mass spectrometer. Since it has been considered so far that the energy of the ions injected to the mass spectrometer 11 is given by a potential difference between the electrode 9 having the second aperture 8 and the endcap 12*a* having the ion entrance opening 14, both electrode 9 and the endcap 12*a* are put at a ground potential in the conventional ion trap mass spectrometer to eliminate the potential difference between both of them, thereby intending to obtain a state in which the energy of the ions injected to the mass spectrometer 11 is reduced to substantially zero. However, it is, actually considered that ions are accelerated to a certain extent of energy by the drift voltage at an instance passing through the second aperture 8. Since the pressure in the differential pumping region 7 is relatively high and the ions frequently collide against the residual gas molecules, it is difficult to exactly recognize the energy of the ions upon passing through the second aperture 8. However, it is considered, a possibility that the energy of ions injected to the mass spectrometer 11 depends on the drift voltage. Accordingly, it is considered that if the drift voltage is increased, the injected energy of the ions is increased thereby lowering the ion confining efficiency and, as a result, the detection sensitivity of the ions is lowered.

As has been described above, the mass spectrometer having the differential pumping region 7 requires a high drift voltage as already described for analyzing the polar compounds at a high sensitivity. However, in the conventional device constitution, if the drift voltage is made higher, the ion detection sensitivity is rather lowered and, after all, to lower the analyzing sensitivity.

SUMMARY OF THE INVENTION

It is accordingly an object of the present invention to provide an ion trap mass spectrometer in which the ion detection sensitivity is not lowered even if a high drift voltage is used and which is suitable to highly sensitive analysis for polar compounds.

For attaining the foregoing object, in accordance with the present invention, a decelerating electric field forming means is disposed between the electrode having the second aperture and the endcap having the ion entrance opening. Actually, by providing a potential difference of a polarity to decelerate ions between the electrode having the second aperture and the endcap having the ion entrance opening, ions accelerated to a high energy by a drift voltage can be injected after being decelerated to a low energy into the mass spectrometer. Further, by controlling the intensity of the decelerating electric field such that the injected energy of the ions to the mass spectrometer can be maintained constant even when the drift voltage is changed, a good ion detection sensitivity can be obtained.

DETAILED DESCRIPTION OF THE PREFERRED EMBODIMENTS

The present invention will be explained more in details by way of preferred embodiments with reference to the drawings.

Figure 1:
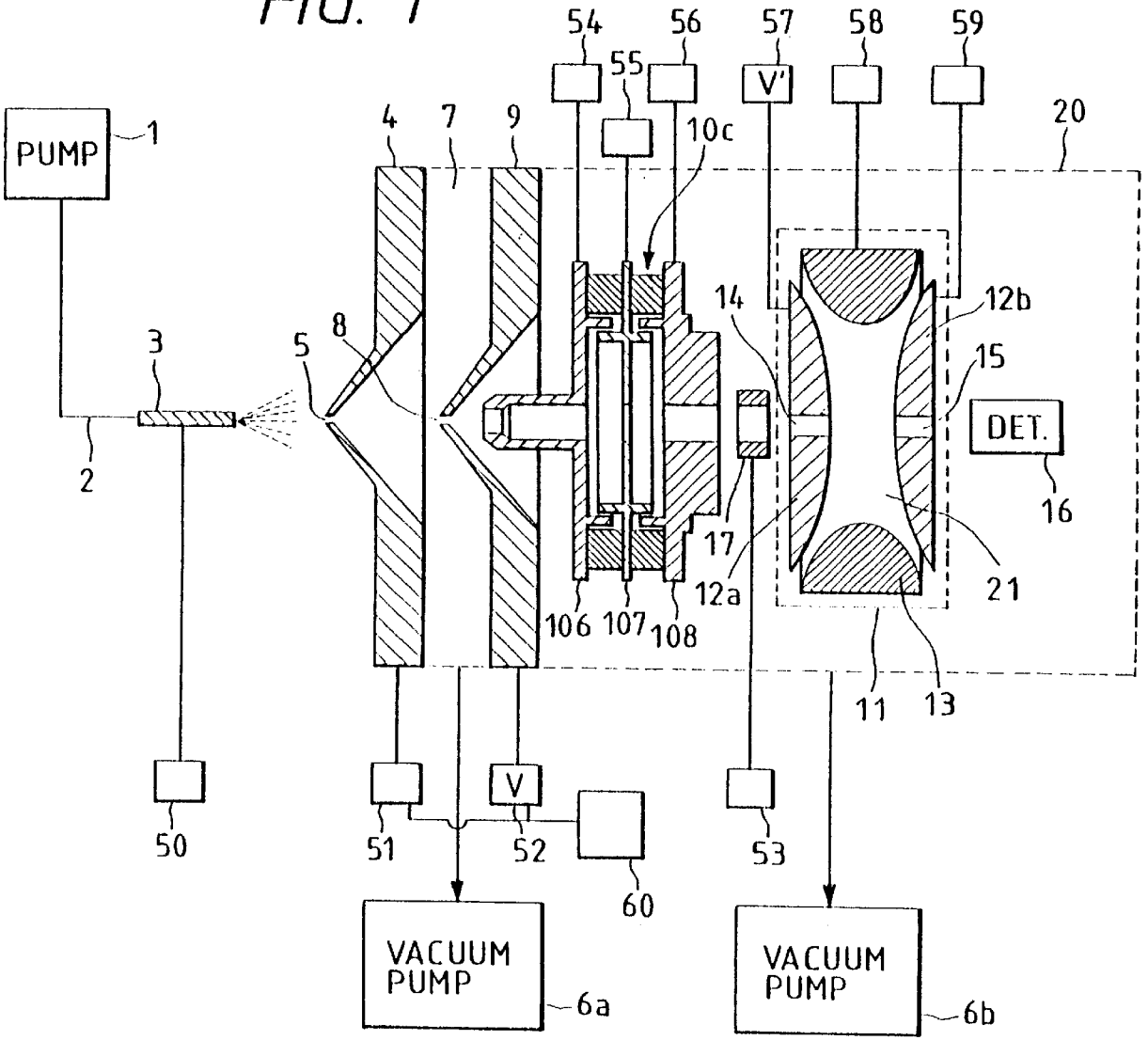
FIG. 1 is a view showing a schematic configuration of an ion trap mass spectrometer as a preferred embodiment according to the present invention.

FIG. 1 shows a schematic configuration of an ion trap mass spectrometer as a preferred embodiment according to the present invention. In FIG. 1, the polarity of voltage applied to each of electrodes is selected depending on the polarity of ions to be analyzed. For the sake of simplicity, explanation is to be made for a case for analyzing positive ions. A sample solution is introduced by way of a liquid feed pump 1 and a pipeline 2 to a metal tube 3 of about 0.4 mm outer diameter (stainless steel tube). A positive high voltage at about 3.5 kV is applied to the metal tube 3. The sample solution is subjected to electrospray by the application of a high voltage from the end of the metal tube 3 to ionize the sample components. Ions formed by the electrospray are introduced while passing through a first aperture of about 0.3 mm inner diameter, introduced into a differential pumping region 7 evacuated by a vacuum system 6*a* to about 0.8 Torr and further entered therefrom through a second aperture 8 of about 0.3 mm inner diameter into a vacuum region 20 evacuated by the exhaust system 6*b* to about $8\times10^{-6}$ Torr.

Figure 2:
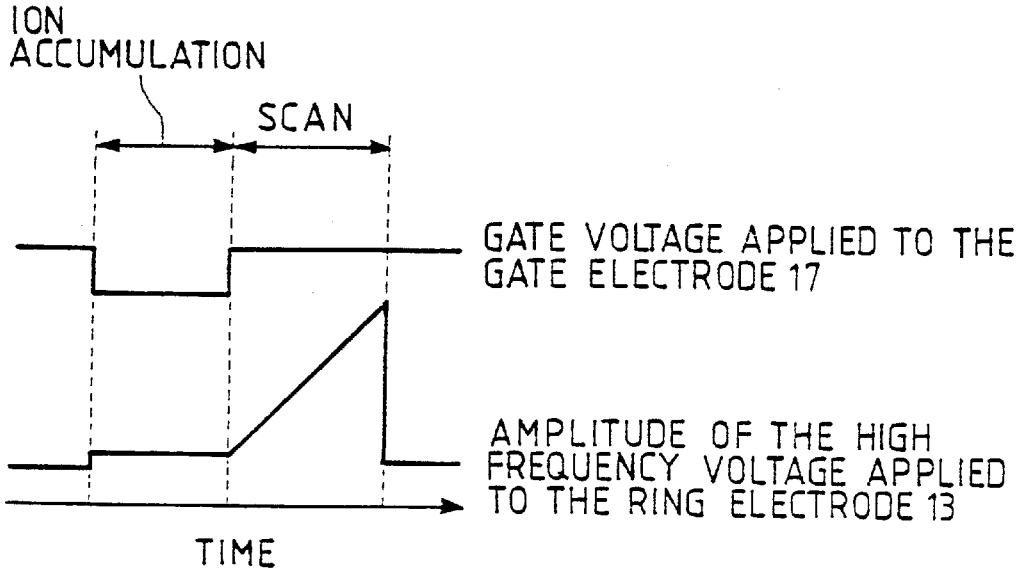
FIG. 2 is a view illustrating a temporal relationship between a voltage applied to a ring electrode and a gate electrode in FIG. 1.

When the ions are introduced by way of the aperture into a region at a lower pressure, the ions are cooled by adiabatic expansion and solvent molecules are attached to the cooled ions, which is a so-called clustering phenomenon. In order to prevent this phenomenon, the electrode 4 provided with the first aperture 5 and electrode 9 provided with the second aperture 8 are heated to about 100° C. by a heating means not illustrated. A drift voltage at about several tens volt is applied between the electrode 4 having the first aperture 5 and the electrode 9 having the second aperture 8 with the electrode 4 being positive. For decelerating ions accelerated by the drift voltage and introducing them at a low injection energy into the mass spectrometer 11, a voltage lower than that for the endcap 12*a* provided with an ion entrance opening 14 is applied to the electrode 9 having the second aperture 8. That is, a voltage V applied to the electrode 9 having the second aperture 8 and the voltage V' applied to the endcap 12*a* having the ion entrance opening 14 are set as: $V<V'$. V' is often set to zero volts in the ion trap mass spectrometer. In the device used in this embodiment, also, V' is set to 0 V, V is set as $V<0$, so that a negative voltage is applied to the electrode 9 having the second aperture 8. The present invention has a feature in making the voltage on the endcap 12*a* having the ion entrance opening 14 higher than the voltage on the electrode 9 having the second aperture 8 irrespective of the injection of the positive ions into the mass spectrometer 11. The positive ions decelerated by the potential difference between V and V' are injected in the mass spectrometer 11 at a low injection energy. The positive injection ions collide against the collision gas in the inner space 21 of the mass spectrometer 11 and are confined in the space 21. Since the energy of the injection ions is low, the ion confinement efficiency is improved. A gate electrode 17 disposed between an electrostatic lens 10*c* constituted with electrodes 106, 107 and 108 and the mass spectrometer 11 has a function of ON/OFF control for the injection of the ions to the mass spectrometer 11. FIG. 2 shows a relation between the voltages applied to the ring electrode 13 and the gate electrode 17 for one scanning period. During accumulation of ions, the voltage applied to the gate electrode 17 (gate voltage) is lowered to allow the passage of the ions. On the other hand, during the so-called scanning period in which ions accumulated in the mass spectrometer 11 are taken out depending on mass successively from the exit opening 15 by changing the amplitude of the high frequency voltage applied to the ring electrode 13 (scanning) and detected by a detector 16 for mass analysis, the gate voltage is increased to prevent further injection of ions into the mass spectrometer 11.

In FIG. 1 are shown power supplies 50, 51, 52 and 53 for supplying necessary voltages to the metal tube 3, electrode 4, electrode 9 and the gate electrode 17, respectively, power supplies 54, 55 and 56 for supplying lens voltages necessary for electrodes 106, 107, 108 constituting an electrostatic lens 10*c*, respectively, and power supplies 57, 58 and 59 for supplying voltages to be applied to the endcap 12*a*, the ring electrode 13 and the endcap 12*b*, respectively.

According to the present invention, since the ions accelerated under the effect of the drift voltage are introduced into the mass spectrometer after deceleration, the ions can be confined efficiently in the ion trap mass spectrometer. Accordingly, polar compounds such as peptides can be analyzed in a state of using a sufficiently high drift voltage, by which detection sensitivity to the ions can be improved to obtain high analyzing sensitivity.

The endcaps 12*a* and 12*b* are sometimes applied with DC or AC voltage with an aim of improving the resolution power or with an aim of ejecting the heavy ions. Further, the voltage may be sometimes different between the ion accumulation period and the scanning period. In such a case, the voltage V' means the DC component of the voltage applied to the endcap 12*a* upon ion accumulation.

Figure 3:
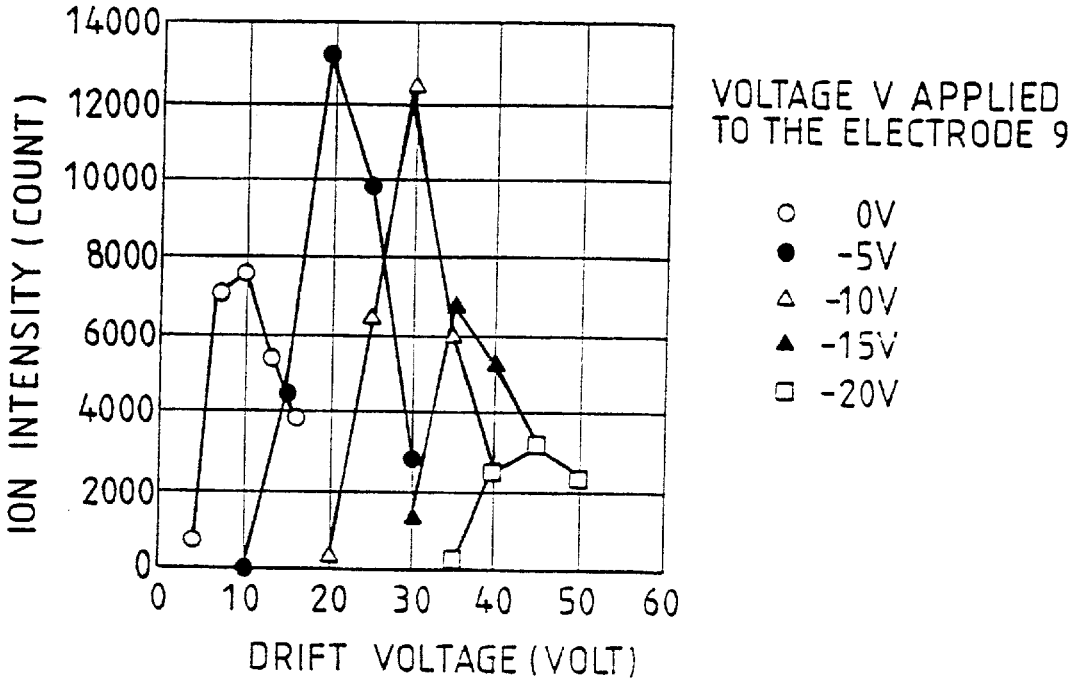
FIG. 3 is a graph explaining the effect of the present invention.

The effect obtained by the present invention will be explained with reference to FIG. 3. FIG. 3 shows a result of the study on the relation between the ion intensity and the drift voltage observed by the mass spectrometer 11 by forming protonated doubly charged ions (m/z=571) of gramicidin-S (molecular weight: 1140) as a sort of peptides by an electrospray method and using the voltage on the electrode 9 having the second aperture 8 as a parameter. Analyzing conditions in this case are shown below. A solvent for a sample solution used was a mixture of water, methanol and formic acid at a 50:50:0.5 ratio. The concentration of the sample was $5\times10^{-6}$ mol/l, the flow rate of the sample solution was 3 $\mu$l/min, and SC voltages of −400 V, −200 V, and −400 V were applied, respectively, to the electrodes 106, 107, 108 constituting the electrostatic lens 10*c*. Further, the DC component V' for the voltage applied to the endcap 12*a* was zero volts. When the voltage V on the electrode 9 having the second aperture 8 was set to zero volts (that is at an equal potential for the electrode 9 and the endcap 12*a*), detected ion intensity was maximum at the drift voltage of 10 V (that is, +10 V is applied to the electrode 4 having the first aperture 5). Further, the detected ion intensity was maximum at the drift voltage of 20 V when the voltage V on the electrode 9 having the second aperture 8 was set to −5 V (that is, +15 V was applied to the electrode 4 having the first aperture 5) and at the drift voltage of 30 V when the voltage V on the electrode 9 having the second aperture 8 was set to −10 V (that is, +20 V was applied to the electrode having the first aperture 5), respectively. The detected ion intensity under the above conditions was twice as large as the detected ion intensity obtained in a case of setting the voltage on the electrode 9 having the second aperture 8 to zero V. As described above, it was confirmed that the detected ion intensity is increased upon detection of positive ions of the peptides by applying a negative voltage relative to the endcap 12*a* on the electrode 9 having the second aperture 8.

While an optimum drift voltage varies depending on device parameters such as vacuum degree in a differential pumping region or the like and the sample, a drift voltage about from 20 V to 30 V is suitable for the case of analyzing gramicidin-S by the device according to this embodiment. However, as can be seen from FIG. 3, the detection ion intensity is lowered, in the prior art method, making it difficult for highly sensitive analysis.

While an optimum value for the drift voltage has to be sought in accordance with the sample substance as an object for analysis, since the energy of the ions injected to the mass spectrometer 11 changes in accordance with the drift voltage, the voltage V applied on the electrode 9 having the second aperture 8 has also to be investigated in a case of optimizing the drift voltage. In the constitution of the device used in this embodiment, when the drift voltage is changed by ΔVd, high detection ion intensity is obtained by changing the voltage V applied on the electrode 9 having the second aperture 8 by about ΔVd/2. For example, when the drift voltage is increased by 10 V, the voltage V applied on the electrode 9 having the second aperture 8 is preferably lowered by about 5 V. In this way, the drift voltage can be optimized more conveniently by a constitution of controlling such that the voltage V applied on the electrode 9 having the second aperture 8 is changed in association with a value of change ΔVd of the drift voltage multiplied with a predetermined coefficient C (C=−½ in this embodiment). More specifically, in the device constitution used in this embodiment, the voltage applied on the electrode 9 having the second aperture 8 may be controlled so as to be lowered by so much as the increase of the voltage applied on the electrode 4 having the first aperture 5 by using a gang control device 60.

When negative ions are analyzed in the device constitution shown in FIG. 1, it will be apparent that the relation regarding the applied voltage is just opposite to the case of analyzing the positive ions described above with respect to positive and negative polarities. In this case, a voltage (positive) higher than that on the endcap 12*a* having the ion entrance opening 14 is applied on the electrode 9 having the second aperture 8. That is, the energy of the ions injected into the mass spectrometer 11 can be lowered to improve the ion confining efficiency by setting the relation as: V>V' between the voltage V applied on the electrode 9 having the second aperture 8 and the voltage V' applied on the endcap 12*a* having the ion entrance opening 14.

Figure 4:
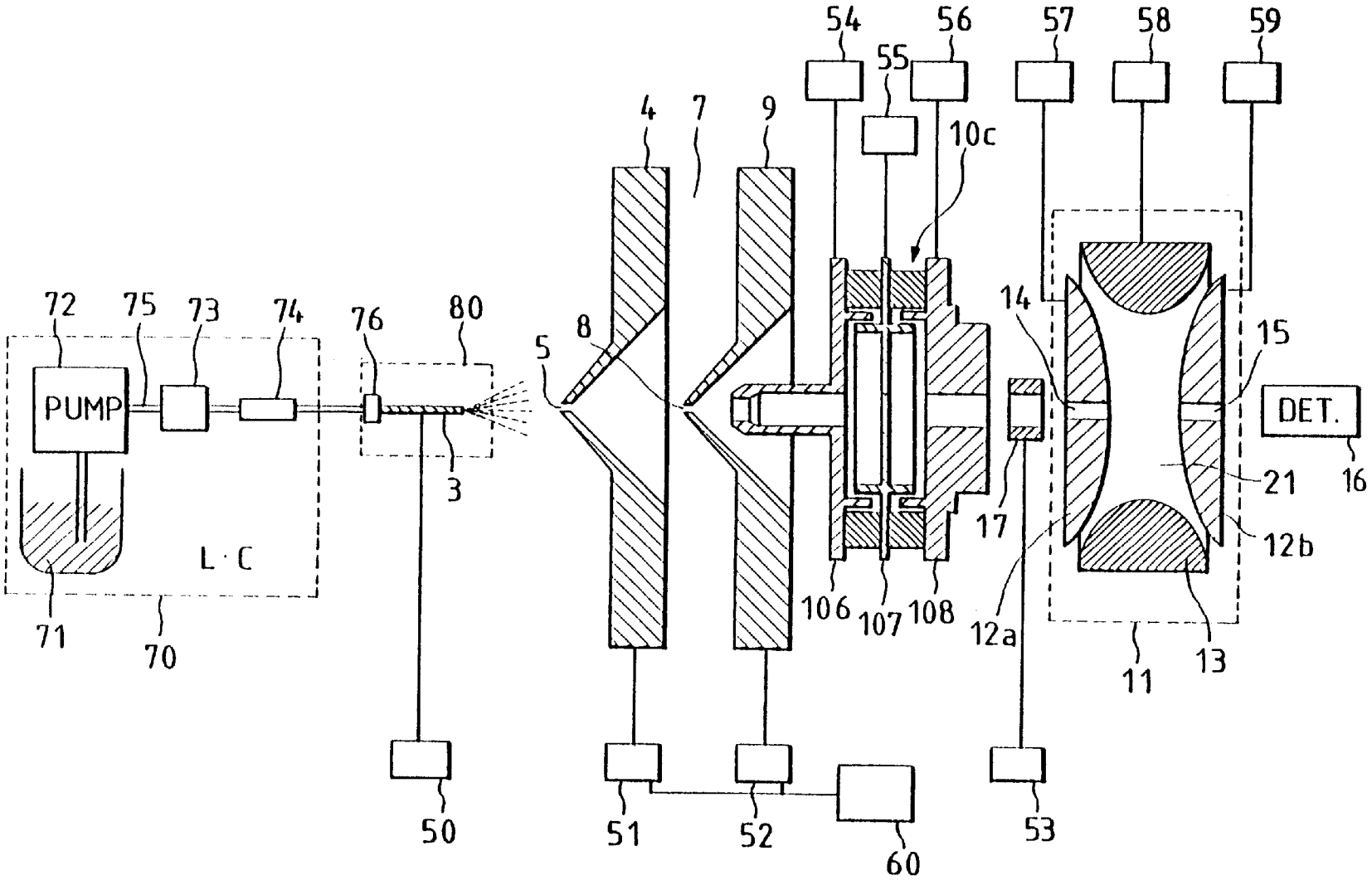
FIG. 4 is a view showing a schematic configuration of a combined device comprising a liquid chromatography (LC) and a mass spectrometer (MS) as another embodiment according to the present invention.
Figure 5:
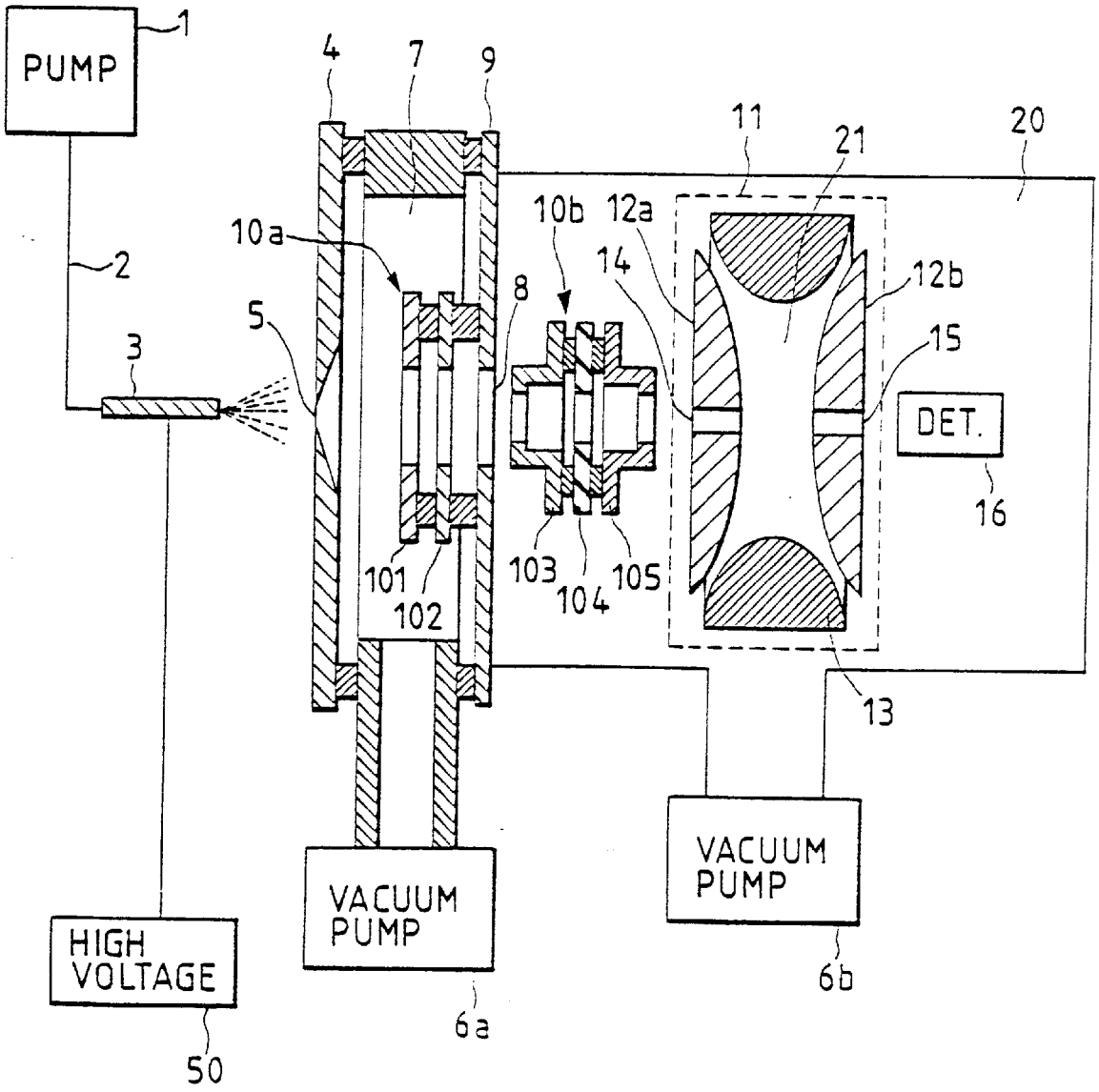
FIG. 5 PRIOR ART
FIG. 5 is a schematic constitutional view of a conventional ion trap mass spectrometer.

FIG. 4 shows a schematic constitution of an entire device in a case of applying the present invention to a combined device of LC and MS (hereinafter simply referred to as LC/MS). An LC section 70 comprises a mobile phase reservoir 71, a feed pump 72, a sample injector 73, a separation column 74 and a pipeline 75 connecting them to each other. The pump 72 delivers a mobile phase solution in the mobile phase reservoir 71 at a constant flow rate into the pipeline 75. The sample is introduced from the sample injector 73 and sent together with the mobile phase solution into a separation column 74. A filler is charged in the separation column 74. The sample is separated in each of components by the interaction with the filler. The separated sample is sent by way of a connector 76 into an ion source 80, and subjected to electrospray by way of a metal tube 3 applied with a high voltage into an atmospheric pressure to be transferred into gaseous ions. The sample components of gaseous ions thus formed are analyzed in the same method as in the method shown in FIG. 1. According to this embodiment, higher analysis sensitivity can be attained also in LC/MS analysis for a mixed sample as compared with the prior art.

Further, the present invention is also effective when applied to a combined device of other separation means such as CE and MS.

The present invention is particularly effective when it is applied to an atmospheric pressure ionization mass spectrometer for forming ions under an atmospheric pressure. Accordingly, the present invention is effective when it is applied not only to the mass spectrometer using the electrospray method as described specifically for the previous embodiment but also to all types of ion trap mass spectrometer using atmospheric pressure ionization such as an atmospheric pressure chemical ionization method utilizing chemical reactions in an atmospheric pressure, a sonic spray method using a high velocity gas stream and an atmospheric pressure spray method of heat spraying the solution.

As has been described above specifically, according to the present invention, ions can be accumulated efficiently in an ion trap mass spectrometer even when a high drift voltage is used. Accordingly, a sufficiently high drift voltage can be used upon analysis of polar compounds and, as a result, analyzing sensitivity for polar compounds such as peptides can be improved.

What is claimed is:

1. A mass spectrometer, comprising:

an ion source unit disposed in a substantially atmospheric pressure region, an ion trap type mass analyzer unit for mass analyzing the ions from said ion source unit, which is disposed in a vacuum region, an intermediate pressure region having a pressure greater than that of said vacuum region and less than that of said atmospheric pressure region, which is disposed between said substantially atmospheric pressure region and said vacuum region, a first electrode having an aperture for introducing the ions from said ion source unit into said intermediate pressure region; said first electrode being disposed between said substantially atmospheric pressure region and said intermediate pressure region, a second electrode having an aperture for introducing the ions from said intermediate pressure region into said ion trap type mass analyzer unit; said second electrode being disposed between said intermediate pressure region and said vacuum region, and an energy control unit for controlling the energy of the ions introduced in said ion trap type mass analyzer unit, wherein said energy control unit includes an electric power supply which applies a voltage on said second electrode for controlling the energy of the ions introduced in said ion trap type mass analyzer unit.

2. A mass spectrometer, comprising:

an ion source for ionizing sample compounds, an ion trap type mass analyzer unit having an endcap electrode, which mass analyzes the ions from said ion source unit, a first electrode having an aperture, which is disposed between said ion source and said ion trap type mass analyzer, a second electrode having an aperture, which is disposed between said first electrode and said ion trap type mass analyzer, wherein each voltage of said endcap electrode, the first electrode and the second electrode differs from one another.

3. A mass spectrometer according to claim 2, further comprising:

a detector for detecting ions ejected from said ion trap type mass analyzer, wherein voltages of said first electrode, said second electrode and said endcap electrode are defined according to the ion intensity detected by said detector.

4. A mass spectrometer according to claim 2, wherein the voltage of said second electrode is less than that of said first electrode.

5. A mass spectrometer according to claim 2, wherein the voltage of said second electrode is less than that of said endcap electrode.

* * * * *